United States Patent [19]

Franke

[11] Patent Number: 4,723,739

[45] Date of Patent: Feb. 9, 1988

[54] SYNCHRONOUS RECTIFICATION TRACK CIRCUIT

[75] Inventor: Raymond C. Franke, Glenshaw, Pa.

[73] Assignee: American Standard Inc., Pittsburgh, Pa.

[21] Appl. No.: 755,525

[22] Filed: Jul. 16, 1985

[51] Int. Cl.[4] ..... B61L 1/00

[52] U.S. Cl. ..... 246/34 C; 246/34 CT; 246/63 C; 246/34 R

[58] Field of Search ..... 246/28 F, 34 B, 34 C, 246/34 CT, 34 R, 122 R, 63 R, 63 A, 63 C; 340/48

[56] References Cited

U.S. PATENT DOCUMENTS

| | | | |
|---|---|---|---|
| 3,526,378 | 9/1970 | Thorne-Booth | 246/122 R |
| 3,970,271 | 7/1976 | Auer et al. | 246/34 R |
| 3,974,991 | 8/1976 | Geiger | 246/34 CT |
| 4,065,081 | 12/1977 | Huffman et al. | 246/34 R |
| 4,304,377 | 12/1981 | Pitard | 246/34 CT |
| 4,306,694 | 12/1981 | Kuhn | 246/34 A |
| 4,314,306 | 2/1982 | Darrow | 246/34 C |
| 4,535,959 | 8/1985 | Gilcher | 245/122 R |

*Primary Examiner*—John W. Caldwell, Sr.
*Assistant Examiner*—Alvin Oberley
*Attorney, Agent, or Firm*—J. B. Sotak

[57] ABSTRACT

An improved audio frequency track circuit system utilizes a synchronous train detection arrangement and reduces the number of fixed code rate modulated carrier signals. As few as two carrier signals are alternately applied at discrete points along a pair of jointless track rails to define the transmitter ends of the track sections, with complementary receivers defining the opposite ends. The two carrier signals are coded at one of two phase angles which are 90° out-of-phase so that, when assigned, the nearest possible interfering signal is 90° out-of-phase and is rejected thereby. Like carrier frequency transmitter/receiver arrangements are disposed on opposite sides of an insulated joint but are coded 180° out-of-phase so that a breakdown of the insulated joint is detected and the false code signal is rejected.

19 Claims, 7 Drawing Figures

DEMODULATED CODE
REFERENCE CODE
(+)
(−)
(+)
(−)
100% AVERAGE RECOVERED D.C.(+)
(+)
0

DEMODULATED CODE
INTERFERING CODE (90° PHASE DIFFERENCE)
(+)
0
(−)
(+)
0
(−)
50% AVERAGE RECOVERED D.C.(+)
(+)
0
COMPOSITE CODE
(+)
0
(−)

DEMODULATED CODE
INTERFERING CODE (180° PHASE DIFFERENCE)
(+)
(−)
(+)
0
(−)
100% AVERAGE RECOVERED D.C.(−)
0
(−)
COMPOSITE CODE
(+)
0
(−)

SYNCHRONOUS RECTIFICATION TRACK CIRCUIT

FIELD OF THE INVENTION

This invention relates to an improved audio frequency track circuit system employing the highly selective characteristics of synchronous detection and, more particularly, to a synchronous train detection arrangement utilizing a reduced number and, as little as two carrier signals which are modulated by a fixed code rate and which are alternately-applied at discrete points along a pair of jointless track rails to define the transmitter ends of the track sections and which are picked up at remote points along the track rails to define the receiver ends of the jointless track sections. The subject AF track circuit system further utilizes a transmitter and receiver arrangement of the same carrier frequency, disposed on opposite sides of an insulated joint and which are coded 180° out-of-phase such that, in the event of a breakdown or even merely deterioration of the insulated joint, an interferring signal of substantially greater magnitude is presented to the receiver across the insulated joint from the transmitter, thereby providing a positive, highly-reliable indication of the breakdown of the insulated joint.

BACKGROUND OF THE INVENTION

Presently, the state-of-the-art in the railroad and/or mass and rapid transit industry for detecting broken down or deteriorated insulated joints and audio frequency (AF) track circuits is not always very reassuring. In the past, the various methods of broken down insulated joint detection involved elaborate schemes in order to prevent false call-on of a train; a false call-on referring to the situation where a later train, normally prevented from entering a previously-occupied block, receives a cab signal to proceed; which cab signal was intended for the earlier, first train that had initially entered the particular block at an opposite end, possibly in order to take a turnout track. Due to the broken down insulated joint, the cab signal is also erroneously transmitted through to the second train, thus falsely calling the second train onto the block initially occupied by the first train. One such elaborate broken down insulated joint detecting scheme has been to utilize a detuning effect that the different frequency transmitter causes with respect to the receiver disposed across the insulated joint and which is tuned to a frequency transmitted from the other end of the block. Thus, it would be highly desirable to provide a secure and reliable method of broken down insulated joint detection in track circuits, particularly at interlockings, where safety is of the utmost importance to prevent damaged equipment and injury to personnel. A further undesirable feature of the present-day audio frequency (AF) track circuits is the large number of carrier frequencies that are required to indicate occupancy on the discrete successive block or track sections; such large number of carrier frequencies inherently increases the potential sources of interference for the particular receiver, transmitter arrangements, due to the large number of differing frequency signals being in such close proximity to one another. In certain AF systems, there are approximately twenty bond-tuning unit combinations because eight carrier frequencies are used. This has a significant impact on the logistics in manufacturing, installation, and maintenance of previous AF track circuit systems.

OBJECTS AND SUMMARY OF THE INVENTION

Accordingly, it is an object of this invention to provide a new and improved audio frequency track circuit system employing the highly selective characteristics of synchronous detection.

A further object of this invention is to provide a unique synchronous rectification detection track circuit system employing only two carrier frequencies, which are alternately-applied to successive blocks in a continuous track section for train detection, and which are repetitively-applied to adjacent blocks which are separated by an insulated joint for detecting insulated joint deterioration.

Another object of this invention is to provide a novel synchronous detection track circuit system, utilizing a first carrier transmitter and a second carrier receiver, located at each end of block sections of a stretch of track for providing train detection and broken down insulated joint protection.

Yet a further object of this invention is to provide a synchronous detection system including a phase-coded carrier transmitter having one phase; and a phase-coded carrier receiver having another phase, but of the same carrier frequency as the phase-coded transmitter, located on opposite sides of an insulated track joint for sensing a breakdown or deterioration in the condition of the insulated joint.

Yet another object of this invention is to provide a synchronous detection track circuit system having a first zero-phase-coded carrier frequency transmitter located at one end of a first block, and a first zero-phase-coded carrier frequency receiver located at the other end of the block, and having a second 90° phase-coded carrier frequency receiver located at the first location, and a second 90° phase-coded carrier frequency transmitter located at the remote end of the adjacent block, and having a first 90° phase-coded carrier frequency receiver located at the remote end of the adjacent block, and having a first 90° phase-coded carrier frequency transmitter located at the remote end of a third block for determining the occupancy of the block by a train.

Yet a further object of this invention is to provide a synchronous detection track circuit system having a plurality of blocks, each defined by a transmitter located at one end and a receiver located at the other end, and wherein successive transmitters have alternate carrier frequencies, and wherein two adjacent transmitters are modulated by code signals having the same phase angle in continuous rail territory, and wherein a transmitter on one side and a receiver on the other side of an insulated joint have the same carrier frequency, but have a different code signal phase angle.

Still another object of this invention is to provide a unique synchronous detection track circuit system comprising, a stretch of continuous railway track having a plurality of block sections, each defined by a transmitter coupled to one end and a receiver coupled to the other end; one of the plurality of block sections includes a transmitter having a first carrier frequency signal which is modulated by code signals having one phase angle and includes a complementary code response receiver; another adjacent one of the plurality of block sections includes a transmitter having a second carrier frequency signal which is modulated by code signals having the one phase angle and also includes a complementary code-responsive receiver; a next adjacent one of the plurality of block sections includes a transmitter having the first carrier frequency signal which is modulated by code signals having another phase angle which is displaced 90° from the one phase angle and includes a complementary code-responsive receiver; a following adjacent one of the plurality of block sections includes a transmitter having the second carrier frequency signal which is modulated by code signals having the other phase angle and includes a complementary code-responsive receiver; a subsequent adjacent one of the plurality of block sections includes a transmitter having the first carrier frequency signal which is modulated by code signals having the one phase angle and includes a complementary code-responsive receiver; a next succeeding adjacent one of the plurality of block sections having the second carrier frequency signal which is modulated by code signals having one phase angle and includes a complementary code-responsive receiver.

Still a further object of this invention is to prove a novel synchronous detection track circuit system comprising, a stretch of railway track having a plurality of block sections, a coded carrier transmitter located at one end and a code-responsive receiver located at the other end of each of the plurality of block sections in an electrically continuous territory, adjacent coded carrier transmitters having alternate carrier signals, and two successive coded carrier transmitters having the same phase angle of code so that the respective associated code-responsive receiver is energized when the block section is unoccupied and is deenergized when the block section is occupied by a train.

An additional object of this invention is to provide an improved synchronous detection track circuit system comprising, a stretch of continuous railway track having a plurality of block sections, each defined by a transmitter coupled to one end and a receiver coupled to the other end; one of the plurality of block sections includes a transmitter having a first carrier frequency signal which is modulated by code signals having one phase angle and includes a complementary code-responsive receiver; another adjacent one of the plurality of block sections includes a transmitter having a second carrier frequency signal which is modulated by code signals having the one phase angle and also includes a complementary code-responsive receiver; a next adjacent one of the plurality of block sections includes a transmitter having the first carrier frequency signal which is modulated by code signals having another phase angle which is displaced 90° from the one phase angle and includes a complementary code-responsive receiver; a following adjacent one of the plurality of block sections includes a transmitter having the second carrier frequency signal which is modulated by code signals having the other phase angle and includes a complementary code-responsive receiver; a subsequent adjacent one of the plurality of block sections includes a transmitter having the first carrier frequency signal which is modulated by code signals having the one phase angle and includes a complementary code-responsive receiver; a next succeeding adjacent one of the plurality of block sections having the second carrier frequency signal which is modulated by code signals having the one phase angle and includes a complementary code-responsive receiver, and a stretch of railway track having a block section which is defined by insulated joints, a transmitter coupled to the track rails on one side of the insulated joints and having a first carrier frequency signal which is modulated by code signals having the one phase angle, and a receiver coupled to the track rails on the other side of the insulated joints and responsive to a coded carrier signal having the first carrier frequency signal which is modulated by code signals having a phase angle which is 180° out-of-phase with the one phase angle, so that a deteriorating insulated joint will result in the reception of a coded carrier signal of the correct frequency but out-of-phase by 180° and of such a substantially greater magnitude due to the proximity of the noncomplimentary receiver/transmitter pair that the broken down insulated joint is positively and reliably detected.

An even further object of the invention is to provide an improved synchronous detection track circuit system having increased signal interference immunity and comprising a stretch of continuous railway track having a plurality of block sections; first of the plurality of block sections including a transmitter with a first carrier frequency signal modulated by code signals having one phase angle and including a complementary code-responsive receiver; an adjacent second of the plurality of block sections including a transmitter with a second carrier frequency signal modulated by code signals having another phase angle which is displaced 90° from the one phase angle and including a complementary code responsive receiver; a next or third of the plurality of block sections including a transmitter with the first carrier frequency signal modulated by code signals having the other phase angle which is displaced 90° from the one phase angle and including a complementary code-responsive receiver; a succession of similarly-arranged transmitter/receiver pairs whereby the assigned carrier frequency signals are alternated and the phase angle of the signal is set such that, the nearest potential source of interference for any given receiver is a transmitter disposed two block sections away and transmits a like carrier frequency signal but is coded 90° out-of-phase with that receiver; this interfering signal is not only of a greatly-reduced magnitude due to the attenuation of the rail, but if erroneously received would also result in a receiver output signal having an average recovered D.C. value of zero.

BRIEF DESCRIPTION OF THE DRAWINGS

The above objects and other attendant features and advantages of the present invention will become more readily apparent and understood from the following detailed description, when considered in conjunction with the following drawings, wherein:-

DETAILED DESCRIPTION OF THE INVENTION

Figure 1:
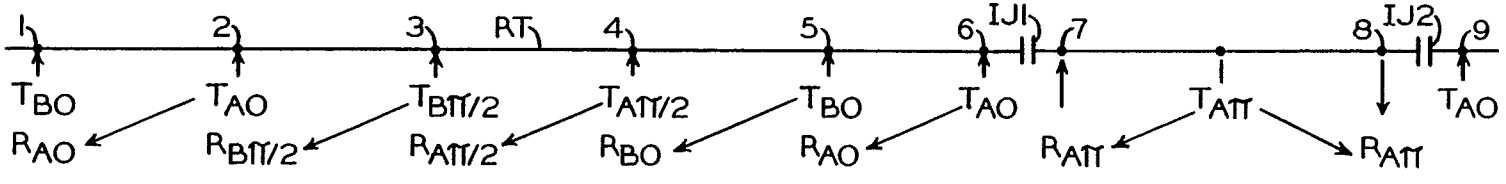
FIG. 1 is a schematic representation of a stretch of railroad track in which the track or block sections for train detection and insulated joint deterioration are defined by a plurality of coded carrier transmitters and complementary receivers having alternate frequencies in the jointless track territory and having the same frequency spanning the insulated joints in accordance with the present invention.
Figure 2:
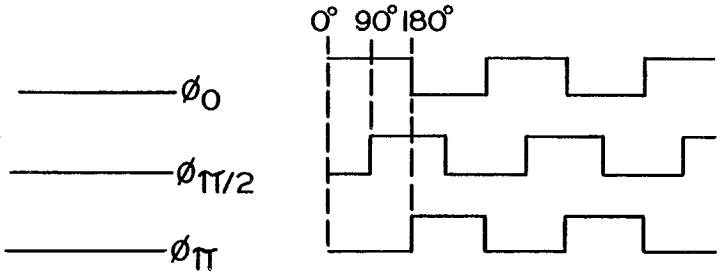
FIG. 2 shows the upper square-wave code signal at zero degrees (0°), the intermediate square-wave code signal at ninety degrees (90°), and the lower square-wave code signal at one hundred and eighty degrees (180°).

Referring now to the drawings, and in particular to FIG. 1, there is shown a stretch of railway track RT which is conveniently represented by a single line. The track RT is divided into a number of discrete track or block sections which are defined by the placement of a plurality of suitably spaced-apart or positioned transmitters and receivers. It will be seen that a transmitter $T_{BO}$ and a receiver $R_{AO}$ are suitably coupled to the rail at point 1, where the uppercase letter T represents a transmitter, the uppercase letter R represents a receiver, the subscripts A and B refer to the two different carrier frequencies, and the subscripts O, $\pi$ and $\pi/2$ represent the phase angle of the code signals as depicted in FIG. 2. It will be noted that a transmitter $T_{AO}$ is coupled to the point 2 to form a first jointless track section between points 1 and 2. A ninety degree (90°) phase displaced receiver $R_{B\pi}/2$ is also coupled to point 2, while its complementary transmitter $T_{B\pi}/2$ is coupled to point 3 to form a second jointless track section. Likewise, a ninety degree (90°) phase displaced receiver $R_{A\pi}/2$ is coupled to point 3 of the track while its complementary transmitter $T_{A\pi}/2$ is coupled to point 4 to form a third jointless section or block. A zero degree (0°) phase receiver $R_{BO}$ is also coupled to point 4 while its complementary zero degree (0°) phase displaced transmitter $T_{BO}$ is coupled to point 5 to form a fourth jointless block. Also, a zero degree (0°) phase displaced receiver $R_{AO}$ is coupled to point 5 while its complementary zero degree (0°) phase displaced transmitter $T_{AO}$ is coupled to point 6 to form a fifth jointless track detection section. Thus, five (5) block sections are formed in the stretch of continuous railway track which extends from point 1 to point 6. It will be seen that the next or sixth track section is defined by insulated joints IJ1 and IJ2, which are necessary at interlockings or turnouts to isolate the main line track section from the siding track section, or the like. As shown, a 180° phase receiver $R_{A\pi}$ is coupled to points 7 and 8, which form the sixth detection section, while a 180° phase transmitter $T_{A\pi}$ is center-fed to this track section. Next, a zero degree (0°) phase transmitter $T_{AO}$ is coupled to the opposite side of insulated joint IJ2 at point 9, and its complementary receiver (not shown) would be coupled to the next track point to form the following track section. I will be understood the subsequent jointless track sections are formed by alternately repeating the two carrier frequencies, and by phase-shifting the code rate 90° of each of the successive or repeated carrier frequencies, as shown in FIG. 1.

By so assigning the carrier frequency signals and phase angles to the receiver/transmitter pairs associated with the shown plurality of blocks, detection of deteriorated or broken down insulated joints and increased immunity to interfering signals can be realized in a positive and reliable manner.

In the situation of the detection of insulated joint failures, as for instance, a deterioration, to some extent, of the insulating properties of insulated joint IJ1 (shown in FIG. 1); the transmitter $T_{AO}$ (shown at point 6) will send a signal through to receiver $R_{A\pi}$ at point 7. However, since this signal, though of the recognized carrier frequency, is 180° out-of-phase with the expected signal, and furthermore, is of substantially greater magnitude than the expected signal due to the proximity of points 6 and 7; a signal-polarity change within the receiver location $R_{A\pi}$ occurs and, since the circuitry is polarity-sensitive (as will be described hereinafter in further detail), the receiver $R_{A\pi}$ will not respond and a false call-on will be prevented.

It can be further appreciated that in the situation of interference from the receiver/transmitter pair at one location with the receiver/transmitter pair at another location, the frequency and phase designations (shown in FIG. 1) provide for an accurate solution as can best be explained by way of an example. It should first be recognized that due to the low number of different carrier frequencies being used, a legitimate safety concern regards the possibility of a transmitter falsely energizing a receiver at another block location. A receiver, for example $R_{B\pi/2}$ (shown at point 2) is synchronized with its complementary transmitter $T_{B\pi/2}$ (shown at point 3); however, since transmitter $T_{BO}$ at point 5 is of the same carrier frequency, under certain conditions, receiver $R_{B\pi/2}$ at point 2 could see the signal from transmitter $T_{BO}$. As will be described hereinafter in further detail and with the aid of the signal comparisons of FIG. 5B, the signal from transmitter $T_{BO}$ will be 90° out-of-phase with respect to the expected signal and furthermore, is attenuated significantly by the length of rail from point 5 to point 2 such that, the falsely-received or interfering signal does not produce any recovered energy through the receiver $R_{A\pi/2}$ but merely changes the waveshape of the expected signal.

As shown in FIG. 2, the upper square-wave code signal $\phi$ is at zero degrees (0°), the intermediate square-wave code signal $\phi_{\pi/2}$ is at ninety degrees (90°), and the lower square-wave code signal $\phi_{90}$ is at one hundred and eighty degrees (180°).

Figure 3:
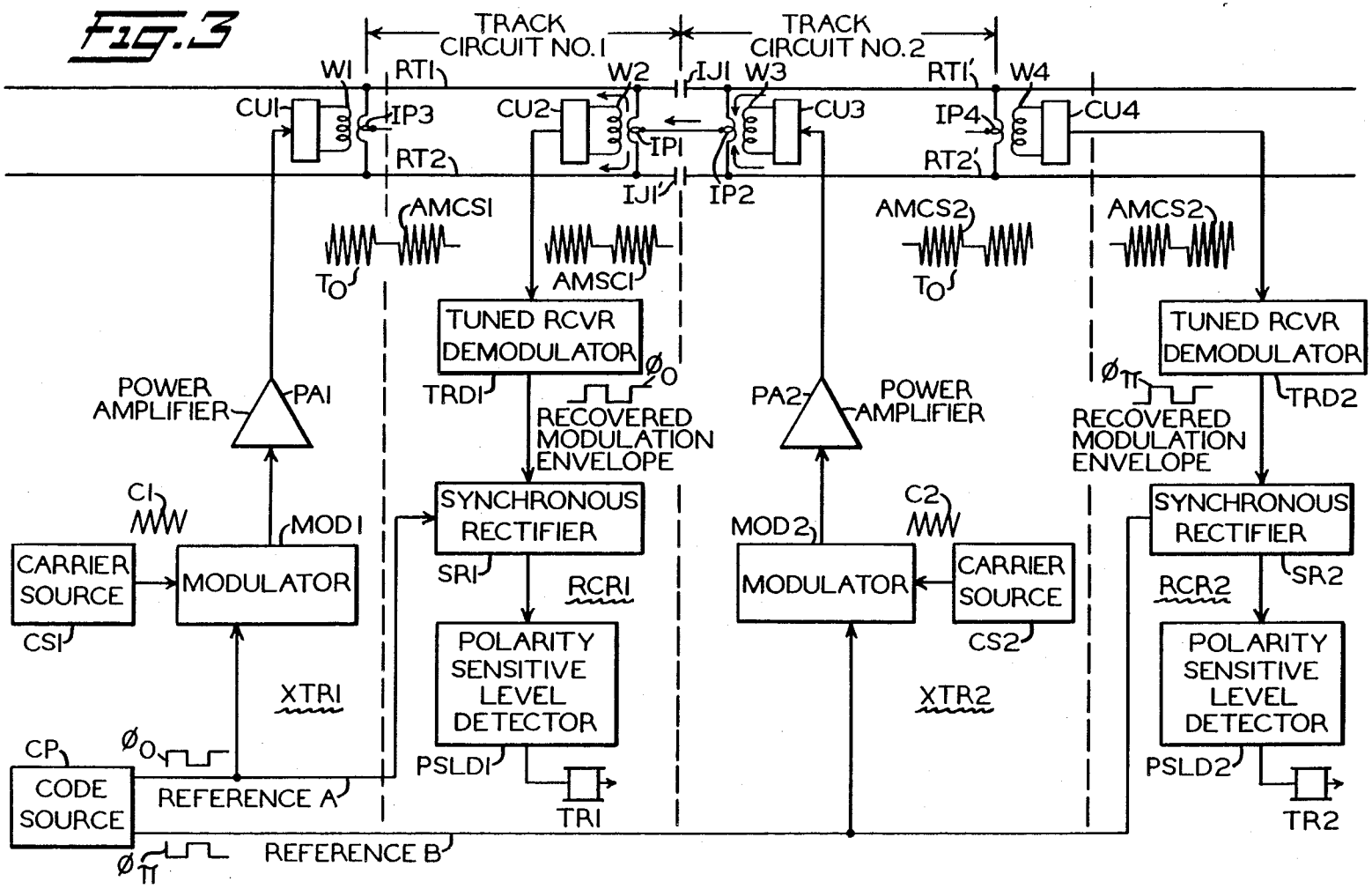
FIG. 3 is a schematic circuit diagram of a pair of railway track sections along with the appropriate coded carrier transmitters and code-responsive receivers of the synchronous train detection system in accordance with the present invention.

Referring now to FIG. 3, the reference characters RT1 and RT2 designate the two track rails of a stretch of railway track which may be located in an area of an interlocking. The insulated joints IJ1 and IJ1' physically divide the track rails into a left-hand portion and a right-hand portion. As shown, a pair of center-tapped transformer winding or impedance bonds IP1 and IP2 are connected across the track rails RT1 and RT2 on either side of the insulated joints IJ1 and IJ1' to provide an electrical circuit path for the train propulsion current, as depicted by the unlabeled arrows in FIG. 3. Further, it will be seen that an impedance bond IP3 is connected on the left-hand side to the track rails to define a first track section or track circuit No. 1, while an impedance bond IP4 is connected on the right-hand side to the track rails to define a second track section or track circuit No. 2. It will be noted that a first coded carrier signal is induced into the impedance bond IP3 by a first coded carrier transmitter XTR1. As shown, the track transmitter unit XTR1 includes a source CS1 of a.c. carrier signals C1 which may have a frequency in the audio range and also includes a source CP1 of square-wave code pulses or signals $\phi o$ which have a frequency in the sub-audio range. The output signals $\phi o$ and C1 are fed to a conventional modulator MOD1 wherein the carrier signals C1 are coded or modulated by the zero phase code pulses $\phi o$ to produce modulated carrier output signals. The modulated carrier signals are fed to a power amplifier PA1 which results in the amplified modulated carrier signals AMCS1. The amplified modulated carrier signals AMCS1 are fed to a tuned L-C coupling unit CU1 which is coupled to transformer winding W1 for inducing modulated carrier signals into track rails RT1 and RT2 via impedance or minibond IP3 of track circuit No. 1. The track circuit No. 1 extends from the minibond IP3 to the insulated joints IJ1 and IJ1', and the minibond IP1 induces the modulated carrier signals AMCS1 into the transformer winding W2 of the receiver unit RCR1. The receiver RCR1 includes a tuned L-C coupling unit CU2 which is coupled to the inductor winding for picking up coded carrier signals from impedance bond IP1. The coupling unit CU2 supplies the coded carrier signals to a tuned receiver demodulating circuit TRD1 which decodes or demodulates the coded carrier signals AMCS1 to produce a replica of the zero phase code signals $\phi o$. The reproduced code signals $\phi o$ are fed to one input of a synchronous rectifier SR1 which will be described in greater detail hereinafter. As shown, the synchronous rectifier SR1 includes a second input which is supplied by the zero phase output $\phi o$ of the code source CP and is assigned the designation of reference A. The output of the synchronous rectifier SR1 is fed to the input of a polarity-sensitive level detector PSLD1 which may be of the type shown and described in U.S. Pat. No. 4,150,417. The vital level detector per se employs a regenerative feedback-type of oscillator and a voltage breakdown device. The oscillator includes a transistor amplifier and a frequency-determining circuit, which is only capable of sustaining a.c. oscillations when the d.c. voltage from the synchronous rectifier SR1 exceeds a predetermined amplitude for causing the breakdown device to conduct and assume its low-impedance condition, so that sufficient regenerative feedback is provided from the output to the input of the transistor oscillator. The a.c. oscillating signals are fed to the input of a multi-stage transistor amplifier, and the amplified a.c. signals are rectified to produce a d.c. output voltage. As shown, the d.c. output signal of the level detector PSLD1 is connected to the coil of a vital-type, polar-biased electromagnetic relay TR1 which is normally energized to indicate the unoccupied condition of the track circuit No. 1.

As previously noted, the second track section or track circuit No. 2 includes an impedance bond IP2 which receives coded carrier signals from a second transmitter XTR2. As shown, the transmitter unit XTR2 includes a source CS2 of a.c. audio carrier signals C2 which is nominally the same frequency as that of source CS1. The transmitter XTR2 also receives square-wave code pulses or signals $\phi\pi$ from the code source CP. However, the phase of the signals $\phi\pi$ is displaced 180° from the phase of the signals $\phi o$ as shown in FIG. 3. The output signals C2 and $\phi\pi$ are fed to a conventional modulator MOD2 wherein the carrier signals C2 are coded or modulated by the code pulses $\phi\pi$ to produce modulated carrier output signals. The modulated carrier signals are fed to a power amplifier PA2 which results in the amplified modulated carrier signals AMCS2. The amplified modulated carrier signals AMCS2 are fed to a tuned L-C coupling unit CU3 which is coupled to transformer winding W3 for inducing modulated carrier signals into track rails RT1' and RT2' via minibond IP2 of track circuit No. 2. The track circuit No. 2 extends from the minibond IP4 to the insulated joints IJ1 and IJ1'. As shown, the minibond IP4 induces the modulated carrier signals AMCS2 into the transformer winding W4 of the receiver unit RCR2. The receiver RCR2 includes a tuned L-C coupling unit CU4. The coupling unit CU4 supplies the coded carrier signals AMCS2 to a tuned receiver demodulating circuit TRD2 which decodes or demodulates the coded carrier signals AMCS2 to produce a replica of the 180° code signals $\phi\pi$. The reproduced code signals $\phi\pi$ are fed to one input of a synchronous rectifier SR2 which is similar to rectifier SR1. As shown, the synchronous rectifier includes a second input which is supplied by the 180° output $\phi\pi$ of the code source CP and is assigned the designation of reference B. The output of the synchronous rectifier SR2 is fed to the input of a polarity-sensitive level detector PSLD2 which is substantially identical to the level detector PSLD1 and which was described in detail hereinbefore. As shown, the d.c. output signal of the level detector PSLD2 is connected to the coil of a vital-type of polar-biased electromagnetic relay TR2 which is normally energized when the track circuit No. 2 is unoccupied.

Figure 4:
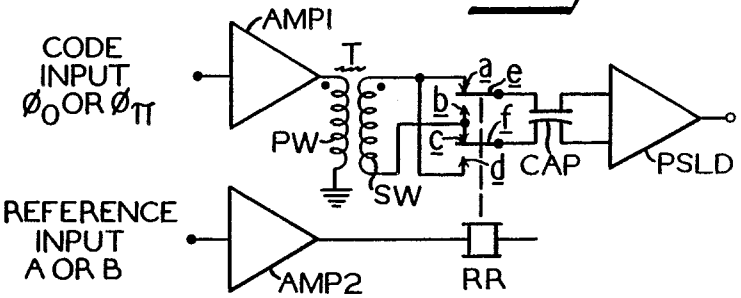
FIG. 4 is a schematic circuit diagram of an electromagnetic mechanical-type of synchronous rectifier circuit which may be employed in the detection system which is shown in block form in FIG. 3.
Figures 5A, 5B, 5C:
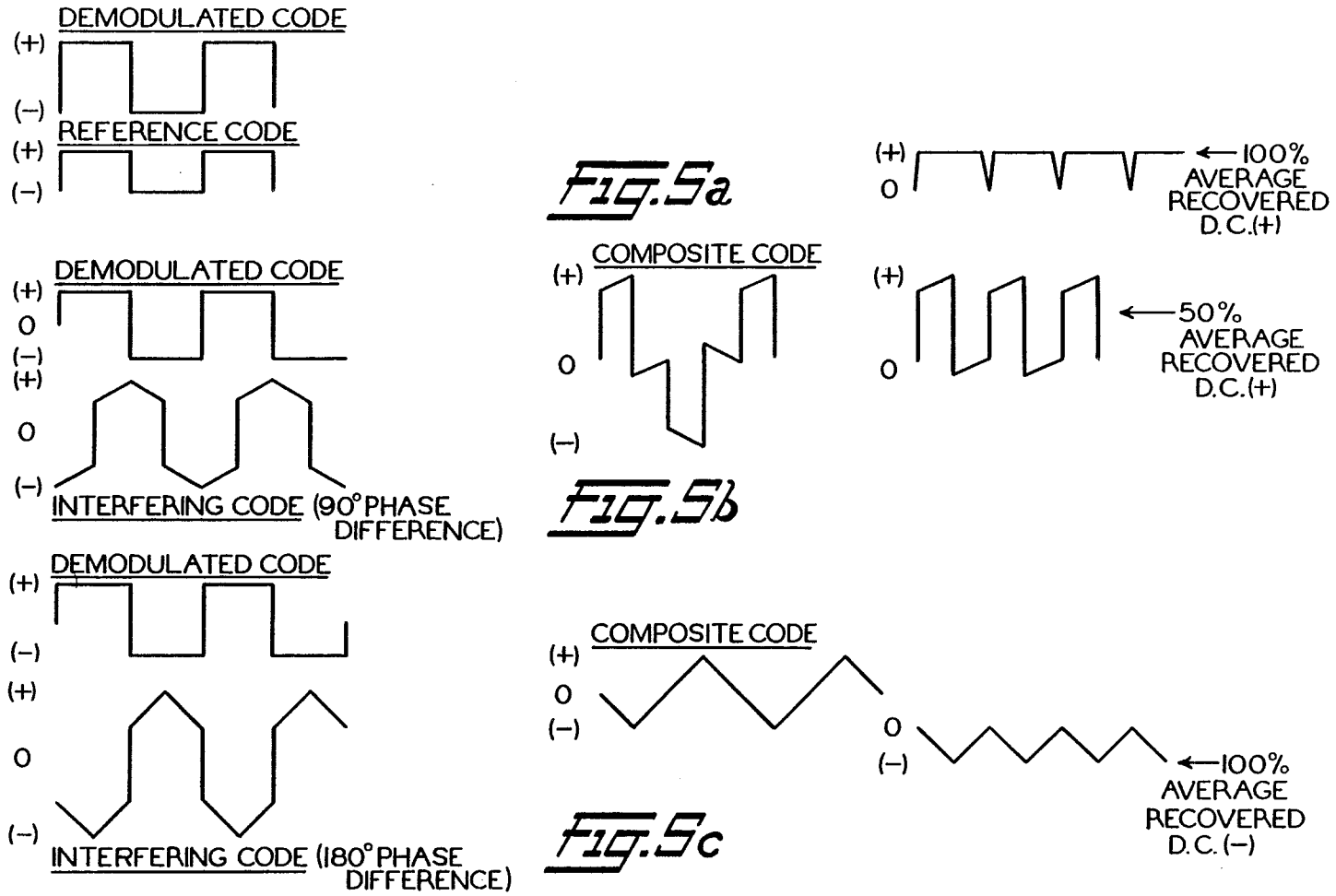
FIGS. 5A, 5B and 5C show a graphic illustration of the various curves of the output signals derived from the synchronous rectifier of FIG. 4 during the presence of certain input signals, namely, normal and interfering signals.

Referring now to FIG. 4, there is shown a suitable-type of electromagnetic or mechanical synchronous rectifying arrangement which may be employed for the rectifiers SR1 and SR2 of FIG. 3. As shown, the synchronous rectifier is adapted to accommodate a pair of inputs, namely, the code input and the reference input. It will be seen that the code input may be either $\phi o$ or $\phi\pi$ while the reference input may be either A or B, dependent upon which track circuit and receiver is being discussed at the time. The code signals are fed to the input of a multi-stage amplifier AMP1 which has its output coupled to the primary winding PW of a step-up transformer T which is designed to operate a sub-audio code rate frequencies. The secondary winding SW of transformer T is connected to the stationary contact a, b, c and d of electromagnetic relay RR in such a way that full-wave rectification is produced when the movable or heel contacts e and f of the relay RR are synchronously switched at the code rate frequency. In viewing FIG. 4, it will be appreciated that movable contact e is connected to one terminal of the upper positive plate of a four-terminal capacitor CAP while the movable contact f is connected to one terminal of the lower negative plate of capacitor CAP. The other terminals of the upper and lower plates of capacitor CAP are connected to the input of the level detector PSLD which may be of the type described above. As shown, the reference signals are appropriately connected to the input of a multi-stage amplifier AMP2 which has its output connected to the coil of the electromagnetic relay RR. Thus, the polarity of the secondary voltage is such that the upper end is initially positive and is conveyed over contacts a and e to the upper plate of capacitor CAP. When the polarity of the secondary voltage reverses on the next half-cycle, the relay contacts reverse so that the upper plate of capacitor CAP is again charged positively over contacts d and f. Thus, the capacitor CAP receives a positive increment of charge on each half-cycle as shown in the diagrams in FIG. 5A. Accordingly, a maximum average recovered d.c. output of a given polarity is achieved when the reference signal and the recovered modulation are in phase. Now, let us assume that one of the insulated joints in FIG. 3 deteriorates to some degree so that a certain amount of resistance is exhibited by the deteriorated insulated joint. Under this condition, a signal source of the same carrier frequency, but coded 180° out-of-phase, is transmitted from transmitter XTR2 across the insulated joint to receiver RCR1 with the recovered modulation being as shown in FIG. 5C. That is, when the insulated joint deteriorates or, in fact, breaks down entirely, a much larger signal, which is one hundred eighty degrees (180°) out-of-phase with the reference signal, is developed which results in a composite that produces a recovered demodulated signal which has negative polarity. Thus, the polarity-sensitive level detector deenergizes the track-occupancy relay to signify a train-occupancy condition. The track relay will remain deenergized until the broken down insulated joint is restored to its normal insulating condition.

Interference situations which may arise between a plurality of block sections, disposed between locations having insulated joints, give rise to an application of the waveforms shown in FIG. 5B. Within such an area, there is the possibility that an impedance bond could become disconnected from the track, which would result in the loss of the normal shunting of the signal through an intermediate bond and thus allow a signal from the next transmitter (operating at the same carrier frequency) to falsely maintain the track circuit in an energized or nonoccupied condition. By being coded 90° out-of-phase, the resultant average recovered d.c. signal is at a 50% value of the strength of the normal demodulated signal (as shown in FIG. 5B) thus effectively rendering the interfering signal transparent to the receiver. The level detector accomplishes this by deenergizing the track occupancy relay (either TR1 or TR2) to signify a false track occupancy condition which will remain until the bond disconnection, which allowed the interfering signal, is corrected.

It will be appreciated that regardless of the manner in which the invention is used, it is apparent that various alterations, modifications, and changes may be made by persons skilled in the art without departing from the spirit and scope of the present invention. Thus, it will be evident that all changes, equivalents, and variations falling within the bounds of the present invention are herein meant to be included in the appended claims.

As an example of such a variation, it is contemplated that, in the situation where two parallel tracks run in close proximity to one another, one method of maintaining the reduced, two-carrier frequency arrangement while still preventing interference from one track to the parallel track, would be to use two distinct code rates. In this manner, a signal could have the same frequency and the same phase angle; but, since the code rate could be assigned to provide the same recovered signal values (as shown in FIGS. 5A, B and C), the integrity of the system would be maintained. Moreover, typically in a parallel track situation, audio frequency track circuit systems have utilized eight (8) carrier frequencies, four for each track. The reduced-carrier frequency scheme of the preferred embodiment also contemplates a four-carrier frequency system for the parallel track situation. As an alternate embodiment, two distinct carrier frequencies could be assigned to each track such that the phase angle and code rate scheme of the original embodiment could be maintained.

Thus, the present invention has been described in such full, clear, concise and exact terms as to enable any person skilled in the art to which it pertains to make and use the same, and having set forth the best mode contemplated of carrying out this invention. We state that the subject matter, which we regard as being our invention, is particularly pointed out and distinctly claimed in what is claimed. It will be understood that variations, modifications, equivalents, and substitutions for components of the above specifically-described embodiment of the invention may be made by those skilled in the art without departing from the spirit and scope of the invention as set forth in the appended claims.

Having thus described the invention, what I claim as new and desire to secure by Letters Patent, is:

1. A synchronous detection track circuit system comprising, a stretch of continuous railway track having a plurality of block sections, each defined by a transmitter coupled to one end and a code-responsive receiver coupled to the other end; one of said plurality of block sections includes a transmitter having a first carrier frequency signal which is modulated by code signals having one phase angle and includes a code-responsive receiver; another adjacent one of said plurality of block sections includes a transmitter having a second carrier frequency signal which is modulated by code signals having said one phase angle and also includes a code-responsive receiver; a next adjacent one of said plurality of block sections includes a transmitter having said first carrier frequency signal which is modulated by code signals having another phase angle which is displaced 90° from said one phase angle and includes a code-responsive receiver; a following adjacent one of said plurality of block sections includes a transmitter having said second carrier frequency signal which is modulated by code signals having said another phase angle and includes a code-responsive receiver; a subsequent adjacent one of said plurality of block sections includes a transmitter having said first carrier frequency signal which is modulated by code signals having said one phase angle and includes a code-responsive receiver; a next succeeding adjacent one of said plurality of block sections includes a transmitter having said second carrier frequency signal which is modulated by code signals having said one phase angle and includes a code-responsive receiver.

2. The synchronous detection track circuit system, as defined in claim 1, wherein each transmitter includes at least one of two sources of carrier signals connectable to a modulator and at least one of two different phase angle sources of code signals connectable to said modulator for coding the carrier signals.

3. The synchronous detection track circuit system, as defined in claim 2, wherein said coded carrier signals are amplified and are coupled to one end of the track by an impedance bond.

4. The synchronous detection track circuit system, as defined in claim 2, wherein each code-responsive receiver is coupled to the other end of the track by an impedance bond.

5. The synchronous detection track circuit system, as defined in claim 4, wherein said impedance bond is connected to a demodulator which decodes the coded carrier signals to provide code signals to a synchronous rectifier which also receives a reference signal from said source of code signals.

6. The synchronous detection track circuit system, as defined in claim 5, wherein a polarity-sensitive level detector is connected to said synchronous rectifier for energizing a polar relay.

7. The synchronous detection track circuit system, as defined in claim 2, wherein a pair of insulated joints define the limits of a block section, a coded carrier transmitter located on one side of the insulated joints and a code-responsive receiver located on the other side of the insulated joints, and wherein the phase of the coded signals of the coded carrier transmitter are 180° out-of-phase with coded signals of the code-responsive receiver to sense deterioration in the insulated joints.

8. The synchronous detection track circuit system, as defined in claim 7, wherein a center-tapped impedance bond is connected across the tracks on opposite sides of said insulated joints.

9. The synchronous detection track circuit system, as defined in claim 2, wherein said two sources of code signals have a 180° phase displacement.

10. The synchronous detection track circuit system, as defined in claim 1, wherein each of said transmitters includes a source of carrier frequency signals and a source of code signals connected to a modulator which supplies coded carrier signals to an amplifier which is coupled to the track rails by an impedance bond.

11. The synchronous detection track circuit system, as defined in claim 1, wherein each of said transmitters includes an impedance bond coupled to the track rails for supplying the coded carrier signals to a tuned circuit demodulator which supplies code signals to a synchronous rectifier which produces a predetermined voltage to a polarity-sensitive level detector to energize an output relay when reference signals applied to the synchronous rectifier are in phase with the code signals.

12. A synchronous detection track circuit system comprising a stretch of continuous railway track having a plurality of block sections, each defined by a transmitter coupled to one end and a code-responsive receiver coupled to the other end; one of said plurality of block sections includes a transmitter having a first carrier frequency signal which is modulated by code signals having one phase angle and includes a code-responsive receiver; another adjacent one of said plurality of block sections includes a transmitter having a second carrier frequency signal which is modulated by code signals having said one phase angle and also includes a code-responisve receiver; a next adjacent one of said plurality of block sections includes a transmitter having said first carrier frequency signal which is modulated by code signals having another phase angle which is displaced 90° from said one phase angle and includes a code-responsive receiver; a following adjacent one of said plurality of block sections includes a transmitter having said second carrier frequency signal which is modulated by code signals having said another phase angle and includes a code-responsive receiver; a subsequent adjacent one of said plurality of block sections includes a transmitter having said first carrier frequency signal which is modulated by code signals having said one phase angle and includes a code-responsive receiver; a next succeeding adjacent one of said plurality of block sections includes a transmitter having said second carrier frequency signal which is modulated by code signals having said one phase angle; a next succeeding portion of said stretch of continuous railway track having insulated joints; an adjacent code-responsive receiver coupled to the track rails on the other side of the insulated joints and responsive to a coded carrier signal having said second carrier frequency signal which is modulated by code signals having a phase angle which is 180° out-of-phase with said one phase angle so that a deteriorating insulated joint will result in cancellation of said coded carrier signal of said adjacent code-responsive receiver.

13. The synchronous detection track circuit system, as defined in claim 12, wherein an impedance bond is connected across the track rails at said insulated joints for receiving the coded carrier signals.

14. The synchronous detection track circuit system, as defined in claim 12, wherein a remote impedance bond is connected across the track rails for defining a block section which is powered by a transmitter having said first carrier frequency signal which is modulated by code signals having a phase angle which is 180° out-of-phase with said one phase angle.

15. The synchronous detection track circuit system, as defined in claim 12, wherein another remote impedance bond is connected across the track rails for defining a block section which includes a receiver which is responsive to a coded carrier signal having said first carrier frequency signal which is modulated by code signals having said one phase angle.

16. The synchronous detection track circuit system, as defined in claim 15, wherein each of said transmitters includes a source of carrier frequency signal and a source of code signals feeding a modulating circuit which supplies a coded carrier signal to an amplifying circuit which feeds amplified coded carrier signals to a tuned coupling unit which is transformer-coupled to said impedance bond.

17. The synchronous detection track circuit system, as defined in claim 16, wherein each of said receivers are transformer-coupled to said impedance bond which supplies said coded carrier signal to a tuned coupling unit which feeds a tuned demodulating circuit which supplies recovered code signals to a synchronous rectifying circuit which receives a reference signal from said source of code signals and which feeds a polarity-sensitive level detector to cause the energization of an electromagnetic relay having reversing contacts.

18. The synchronous detection track circuit system, as defined in claim 17, wherein said synchronous rectifying circuit includes an electromagnetic rectifier.

19. The synchronous detection track circuit system, as defined in claim 12, wherein said receiver includes a recovering means for decoding a received said coded carrier signal having said one phase angle and producing a recovered average D.C. signal of negative value therefrom such that a polarity change occurs within said receiver thereby resulting in such rejection of said coded carrier signal of said one phase angle by said receiver.

* * * * *